US005435859A

United States Patent [19]

Torii et al.

[11] Patent Number: 5,435,859

[45] Date of Patent: Jul. 25, 1995

[54] METHOD OF PRODUCING A RARE EARTH BOND MAGNET

[75] Inventors: Michihiro Torii; Masanao Okuda; Yoshikazu Ikeda, all of Hamamatsu, Japan

[73] Assignee: ERD Corporation, Japan

[21] Appl. No.: 102,057

[22] Filed: Aug. 4, 1993

[30] Foreign Application Priority Data

Aug. 6, 1992 [JP] Japan ..... 4-231346

[51] Int. Cl.[6] ..... H01F 1/057

[52] U.S. Cl. ..... 148/103; 148/101; 148/104

[58] Field of Search ..... 148/101, 103, 104

[56] References Cited

U.S. PATENT DOCUMENTS 4,792,367 12/1988 Lee ..... 148/104
4,913,745 4/1990 Sato et al. ..... 148/103
4,921,551 5/1990 Vernia et al. ..... 148/101
4,973,415 11/1990 Ohmachi et al. ..... 252/63.53

*Primary Examiner*—John Sheehan
*Attorney, Agent, or Firm*—Wenderoth, Lind & Ponack

[57] ABSTRACT

A method of producing a rare earth anisotropic bond magnet comprising the steps of:

melting an aloy composed of 10–30 atom % of R (wherein R designates at least one rare earth element including yttrium), 2–28 atom % of boron and 65–82 atom % of M (wherein M designates at least one of iron, cobalt and nickel) and rapidly cooling the melted alloy to produce powder material, subjecting the material to stamping at the temperature of 300°–900° C. in an inert gas atmosphere to pulverize and press the material to a scaly shape and cooling the pulverized material so that a magnetic anisotropy is produced in the vertical direction relative to the pressed surface.

9 Claims, No Drawings

METHOD OF PRODUCING A RARE EARTH BOND MAGNET

BACKGROUND OF THE INVENTION

The present invention relates to a method of producing a rare earth bond magnet (anisotropic) which uses as a raw material rare earth alloys prepared by a rapid cooling thin belt forming method, (melt quenching method) and more particularly, the present invention is directed to a method of producing an anisotropic rare earth bond magnet of scaly shape which has a vertical magnetic anisotropy relative to a pressing surface by heating a raw material of rare earth alloys and pulverizing and pressing it by the addition of an external stress. The magnet material as described is suitable for the production of a resin-impregnated bond magnet having a magnetic anisotropy.

Further, the present invention is directed to a method of producing a rare earth bond magnet in which magnet powder material composed of a rare earth alloy is mixed with non-metallic inorganic binders and the mixture is subjected to molding and then treated by a low temperature heat treatment so that the crystal shape thereof is not changed, wherein the particles of the powder material are bonded to each other by the resolved binders.

The rare earth bond magnets which have been on actual use are generally classified into Sm-Co magnets and Nd-Fe-B magnets, and the Nd-Fe-B magnets are produced by forming amorphous ribbons by rapidly cooling (or melt quenching) a melted alloy, followed by a heat treatment and pulverization to thereby provide a desired powder material. This powder is anisopropic and an anisotropic bond magnet can be formed by using the same, as disclosed by Japanese Patent Publication (Unexamined) No. 59-64739.

Japanese Patent Publication (Unexamined) No. 60-100402 discloses the production of powder having magnetic anisotropy, in which the amorphous ribbons are pulverized and then heat pressed to form moldings (molded products). Thereafter, the molded products are heat-pressed at about 750° C. and compression-molded to extend them in the lateral direction, and at this moment, crystal organization is arranged to provide a magnetic block having a magnetic anisotropy. Then, the magnetic block is pulverized to form powder of anisotropy.

However, in order to produce the magnetic anisotropic powder by means of the conventional method, it requires a compressive molding at a high temperature and an extention operation in an inert gas atmosphere. This requires a substantial length of time and, therefore, results in substantial reduction of productivity. Further, the thus produced anisotropic block has a very high hardness which presents difficulty in pulverization.

In order to solve the problems of pulverizing the anisotropic blocks, an attempt has been suggested to repeatedly absorb and discharge hydrogen to thereby granulate the block material. In this method, however, the resultant shape of the powder is influenced by the crystal shape of the ungranulated anisotropic block. Further, this method is disadvantageous in that particle size distribution of the powder is scattered largely, with the result of unstable properties of the bond magnets.

SUMMARY OF THE INVENTION

An object of the present invention is to provide an improved method of producing a rare earth anisotropic bond magnet.

Another object of the present invention is to provide an improved method which can exclude the step of forming blocks, by simply heat pressing directly the raw material so that the productivity can be improved.

Another object of the present invention is to provide a new method of producing a magnetic anisotropy pellet by utilizing a shape anisotropy and a new method of producing an anisotropic resin-impregnated bond magnet with the use of the pellet.

A further object of the present invention is to provide a new method of producing a bond magnet of a high density by using a non-metallic inorganic binder.

According to the present invention, there is provided a method of producing a rare earth anisotropic bond magnet comprising the steps of:

melting an alloy composed of 10–30 atom % of R (wherein R designates at least one rare earth element including yttrium), 2–28 atom % of boron and 65–82 atom % of M (wherein M designates at least one of iron, cobalt and nickel)and rapidly cooling the melted alloy to produce powder material, subjecting the material to stamping at a temperature of 300°–900° C. in an inert gas atmosphere to pulverize and press the material to a scaly shape, and cooling the pulverized material so that a magnetic anisotropy is produced in the vertical direction relative to the pressed surface.

The powder material used in the present invention has a size of about 20–40 $m^2$. The inert gas used for the inert gas atmosphere is selected from argon gas, nitrogen gas and the mixture of the two. The primary reason for conducting the stamping at the temperature of 300°–900° C. is that a lower temperature than 300° C. provides a mere pulverization and failure in extension effect and a higher temperature than 900° C. results in a rapid reduction of the magnetic properties. The temperature range between 30° and 900° C. provides a desirable flexibility and therefore the material is readily extensible. It is generally known that boron is eluted at about 600° C. and, if an impact is added thereto at the temperature of 300°–900° C., the eluted boron in the particle enters the grain boundary to produce a unitary (single) magnetic domain and, therefore, the crystalline orientation is arranged in the same direction so that it becomes anisotropic. In addition, a small amount of hydrogen can be added to provide the atmosphere with some reduction. Since hydrogen is active and 1000 ppm of hydrogen is sufficient. The addition of hydrogen produces brittleness and the material can be readily rolled and pulverized.

In place of stamping, rolling by a roller mill can be applied. In this case, the material produced by the rapid cooling (melt quenching) method is pre-heated at 700°–900° C. in the inert gas atmosphere and then rolled by a roller mill which is heated to 800°–900° C. to produce particles of a scaly shape. As similar as the previous case, the crystalline orientation is arranged in the same direction and, therefore, a magnetic anisotropy can be obtained.

The desired rare earth elements can be selected from, for example, neodymium, praseodymium, lanthanum, cerium, samarium, gadolinium, promethium, europium, lutetium, dysprosium, terbium, holmium, etc. Although yttrium is not classified as a rare earth element, it can be used in the present invention as similar as the rare earth elements described above. Less than 10 atom % of R results in inferiority of magnetic coersive force (iHc-)and more than 30 atom % of R results in reduction of residual magnetic flux density (Br) and, therefore, the amount of R which is out of the range between 10 and 30 atom % results in failure of desired magnets of high properties. One of the most desirable rare earth elements applicable to the present invention is neodymium (Nd) and, if desired, neodymium can partly be substituted by dysprosium (Dy), terbium (Tb), praseodymium (Pr) or other rare earth elements. In addition, less than 2 atom % of boron (B) results in reduction of coersive force and more than 28 atom % thereof results in reduction of residual magnetic flux density. The composite of the rare earth alloy is preferably selected from stoichiometric composite $Nd_{13}Fe_{82.7}B_{4.3}$ or its similarities.

The anisotropic bond magnet material produced by the aformentioned method can be produced into rare earth bond magnet by various known methods. In the method of orientation of the anisotropic particles, particles are suspended in the water or other dispersing solvents and then its slurry is filled in a mold and subjected to compression molding at the same time of dehydrating in the orientational magnetic field. This process can provide the highest degree of orientation but, on the other hand, is less productivity and less freedom of selection of molding shape and magnetic orientation. Thus, in the most frequently used method, the raw material powder and synthetic resins such as epoxy resin are mixed and then pulverized to single-particle (grain). In case of the anisotropic bond magnet material in the present invention, the raw material is mixed with thermosetting or thermoplastic resins and then subjected to a mechanical orientation by means of rolling method or extrusion molding method, by the use of the shape anisotropy of the scaly, or scale-shaped, particles. At the time of the mechanical orientation, a magnetic field can be applied supplementally so that higher orientation degree is obtained. The oriented intermediate product thus molded is pulverized to form granules (pellet-like material) and then a magnetic field is applied to the pellets to provide orientation. Then, the pellet thus magnetized is press-molded to form an anisotropic resin bond magnet.

As described above, the material is subjected to a roller press treatment or stamping treatment in an inert gas atmosphere of high temperature so that the crystals therein are deformed and, at the same time, the crystals are oriented in the same direction. Thus, induced-magnetic anisotropy constant generated by a residual strain due to a production stress can be increased, so that scaly powder can be obtained which has a magnetic anisotropy in the extending (stretching) direction of the particles. By utilizing the consistancy in the axial surface between the shape-anisotropy of the particles and the magnetic anisotropy thereof, a sheet-shaped mold product is formed by a roll mill method or extrusion method, and a product which has particle orientation in the laminated direction can be produced easily. In the stamping treatment, the material can be pulverized to a desired particle size which is suitable for the predetermined orientation.

By pulverizing the powder having the particle orientation as described above, a pellet with predetermined crystal particles having a large magnetic moment of the particle orientation at the time of magnetic press-molding can be obtained. This pellet is then classified, which is of high density. Thus, a problem of uniformity in size of the powder particle at the time of filling the powder into the mold is solved. In addition, the particle size of it is ten times as large as that of a single-particle and, therefore, a magnetic moment thereof becomes larger when a magnetic field is applied thereto and, consequently, the degree of magnetic orientation at the time of dry magnetic field molding can be improved.

According to a second aspect of the present invention, the invention is directed to a method of producing a rare earth bond magnet in which magnet powder material composed of a rare earth alloy is mixed with non-metallic inorganic binders and the mixture is subjected to molding and then treated by a low temperature heat treatment so that the crystal shape thereof is not changed wherein the particles of the powder material are bonded to each other by the resolved binders.

In the second aspect of the invention, there is provided a method of producing a rare earth anisotropic bond magnet comprising the steps of:

melting an alloy composed of 10–30 atom % of R (wherein R designates at least one rare earth element including yttrium), 2–28 atom % of boron and 65–82 atom % of M (wherein M designates one of iron, cobalt and nickel) and subjecting the melted alloy to a melt quenching method to produce magnet powder, adding a non-metallic inorganic binder to the magnet powder, subjecting the magnet powder to molding at a room temperature, heat treating the molded product in an inert gas atmosphere at a temperature of 600°–900° C. to thereby bonding the powder due to the binder solution.

PREFERRED EMBODIMENTS OF THE INVENTION

EXAMPLES 1–3

As a starting material, an alloy composed of 13 atom % of neodymium (Nd), 82.7 atom % of iron (Fe), 4.3 atom % of boron (B) was prepared by a high frequency melting furnace. The resultant alloy was treated by a single-roll method to form a quenched ribbon and then subjected to a heat treatment. The heat-treated ribbon was pulverized to 100–1000 μm (micron) to obtain powder material for bond magnets. This material was magnetically isotropic. Thereafter, the raw material was supplied into a mortar and the sealed container for the mortar was substituted with argon gas, and heated at 400° C. (Example 1), 550° C. (Example 2)and 750° C. (Example 3), followed by a 30 minutes stamping for pulverization. Average particle size of the pulverized powder was about 30 μm or less by the measurement of air penetration method. The resultant powder was mixed with epoxy resin so that a powder content was 97 wt %. Thus, a mixture for molding was obtained. The mixture was press-molded at a molding pressure of $5t/cm^2$ in an orientational magnetic field to produce three types of anisotropic bond magnets.

COMPARATIVE EXPERIMENTS 1 AND 2

The same raw material as the powder material described above was used and pulverized in a similar manner as described above by the same pulverizer, except that room temperature (Comparative Ex. 1) and 200° C. (Comparative Ex. 2) were applied. An average particle size of the resultant powder was 19 μm and 18 μm, respectively. This magnet powder was used under the same conditions as those of Examples 1–3 of the present invention to form two types of bond magnets.

Magnetic characteristics in the orientational direction of magnetic field and the vertical direction thereof were measured by a B-H tracer with respect to the samples prepared by Examples 1–3 and Comparative Experiments 1–2. At the same time, a density was measured. The measurement results are shown in Table 1 below.

As shown in Table 1, in the samples of Examples 1–3, magnetic characteristics between the orientational direction of magnetic field and its vertical direction are clearly recognized, and superior magnetic characteristics are. found in the magnetic field orientation direction. In addition, this shows that the magnetic characteristics are improved when the heating temperature is elevated higher. By contrast, in the Comparative Experiments 1 and 2, if the powder material is subjected to no heating treatment or a low heating treatment, the powder is magnetically isotropic, with the result that only undesired bond magnets of lower characteristics were obtained.

TABLE 1

| | Pulverizing temperature | Direction of measurement | Br (kG) | iHc (kOe) | (BH)max (MGOe) | Density (g/cm$^3$) |
|---|---|---|---|---|---|---|
| Ex. 1 | 400° C. | orientational | 7.0 | 10.9 | 10.5 | 6.03 |
| | | vertical | 6.0 | 10.9 | 8.2 | 6.03 |
| Ex. 2 | 550° C. | orientational | 7.6 | 10.5 | 12.3 | 6.01 |
| | | vertical | 5.2 | 10.7 | 5.8 | 6.01 |
| Ex. 3 | 750° C. | orientational | 8.3 | 10.1 | 14.2 | 6.04 |
| | | vertical | 4.2 | 10.2 | 4.0 | 6.04 |
| Com. | Room | orientational | 6.5 | 11.3 | 9.0 | 5.92 |
| Ex. 1 | Temp. | vertical | 6.5 | 11.3 | 9.0 | 5.92 |
| Com. | 200° C. | orientational | 6.4 | 11.0 | 8.7 | 5.93 |
| Ex. 2 | | vertical | 6.4 | 11.0 | 8.7 | 5.93 |

In the table, "orientational" means an orientational direction and "vertical" a vertical direction relative to the orientational direction.

EXAMPLES 4 AND 5

As a starting material, an alloy composed of 13 atom % of neodymium (Nd), 82.7 atom % of iron (Fe), 4.3 atom % of boron (B) was prepared by a high frequency melting furnace. The resultant alloy was treated by a single-roll method to form quenched ribbon and then subjected to a heat treatment. The heat-treated ribbon was pulverized to 53–500 μm (micron) to obtain powder material for bond magnets. This material was magnetically isotropic. Thereafter, the raw material was preheated at 750° C. and roll-pressed continuously by the roll mill having the set surface temperature of 800° C. (Example 5) and 900° C. (Example 4). The resultant powder was mixed with epoxy resin so that a powder content was 97 wt %. Thus, a mixture for molding was obtained. The mixture was press-molded at a molding pressure of 5 t/cm$^2$ in an orientational magnetic field to produce two types of anisotropic bond magnets.

COMPARATIVE EXAMPLES 3

The same raw material as those of Examples 4 and 5 was used and pulverized by the same pulverizer in the similar manner as in the Examples 4 and 5. However, in the comparative experiment, no pre-heating was carried out. Temperature of the surface of the roller was 25° C. Bond magnets were produced by using the material under the same conditions as those in Examples 4 and 5.

Magnetic characteristics in the magnetic field orientation direction and the vertical direction thereof were measured by a B-H tracer with respect to the samples prepared by Examples 4 and 5, and Comparative Experiment 3. At the same time, a density was measured. The measurement results are shown in Table 2 below. As shown in Table 2, the samples of Examples 4 and 5 have superior magnetic characteristics in the magnetic orientation direction which shows that a magnetic anisotropy can be added thereto. By contrast, in the samples of Comparative Experiment 3, the powder is magnetically isotropic in case that no pre-heating is carried out and temperature of the roller is relatively low, with the result that only undesired bond magnets of lower characteristics were obtained.

TABLE 2

| | Pulverizing temperature | Direction of measurement | Br (kG) | iHc (kOe) | (BH)max (MGOe) | Density (g/cm$^3$) |
|---|---|---|---|---|---|---|
| Ex. 4 | 800° C. | orientational | 8.0 | 10.1 | 14.1 | 6.03 |
| | | vertical | 4.1 | 10.2 | 3.9 | 6.03 |
| Ex. 5 | 900° C. | orientational | 8.2 | 9.6 | 13.8 | 6.02 |
| | | vertical | 3.8 | 9.8 | 3.8 | 6.02 |
| Com. | 25° C. | orientational | 6.5 | 11.3 | 9.0 | 5.92 |
| Ex. 3 | | vertical | 6.5 | 11.3 | 9.0 | 5.92 |

According to the first aspect of the present invention, the rare earth material by a melt quenching method is mechanically pressed by stamping or rolling to provide a scaly form and, accordingly, the crystal thereof can be deformed and the crystalline direction can be oriented. Further, inducing magnetic anisotropy constant which is produced by a residual strain by a production stress can be increased, and desired bond magnets having magnetic anisotropy in the vertical direction relative to the pressed surface of the material can be obtained. This method can omit the steps of forming blocks and crushing the blocks which are needed in the conventional method.

Further, in the present invention, pellets having particles of magnetic anisotropy can be produced by utilizing the shape anisotropy of the magnet material. The pellets which are classified have a high density and improvement in filling in the mold can be achieved. The particle size is at least ten times as large as the single-particle and, therefore, a larger magnetic moment can be expected when a magnetic field is applied thereto. Thus, the degree of magnetic orientation in the dry magnetic field molding can be improved. This pellet can be used to produce a resin bond magnet having high magnetic properties.

According to a second aspect of the present invention, the invention is directed to a method of producing a rare earth bond magnet in which magnet powder material composed of a rare earth alloy is mixed with non-metallic inorganic binders and the mixture is subjected to molding and then treated by a low temperature heat treatment so that the crystal shape thereof is not changed wherein the particles of the powder material are bonded to each other by the resolved binders.

In the second aspect of the invention, there is provided a method of producing a rare earth anisotropic bond magnet comprising the steps of:

melting an alloy composed of 10–30 atom % of R (wherein R designates at least one rare earth element including yttrium), 2–28 atom % of boron and 65–82 atom % of M (wherein M designates at least one of iron, cobalt and nickel) and subjecting the melted alloy to a melt quenching method to produce magnet powder, adding a non-metallic inorganic binder to the magnet powder, subjecting the magnet powder to molding at a room temperature, and heat treating the molded product in an inert gas atmosphere at a temperature of 600°–900° C. to thereby bonding the powder due to the binder solution.

This method is useful not only for anisotropic bond magnets, but also for isotropic bond magnets of no orientation magnetic field is applied. In order to produce an anisotropic bond magnet, the leaf or powder material produced by a melt quenching method is subjected to stamping at a temperature of 300°–900° C. in an inert gas atmosphere and then pulverized and pressed to form scaly particles. Then, a cooling is carried out to provide a magnetic anisotropy in a vertical direction relative to the pressed surface. Then, a non-metallic inorganic binder is added to the magnet material and then molding is carried out at room temperature in orientational magnetic field. Preferably, the material added with the inorganic binder is mechanically oriented by a mixing roller to provide a flake form and then granulated. The resultant granulates are then molded in the orientational magnetic field.

The non-metallic inorganic binders applicable to the present invention are selected from those which can be melted at a relatively low temperature and elutable to a surface of a mold product to close the surface pores, such as phosphorous oxide, vanadium oxide, low temperature glass and a mixture thereof.

The rare earth elements described presently in the first aspect of the present invention can be also used in this second aspect of the invention.

After the powder particles are bonded together due to melted binders in a heat treatment, it is preferred that a densification treatment is carried out under the condition of 600°–900° C. in an inert gas atmosphere and 100–6000 atmospheric pressure by means of a high isostatic press. This densification treatment can be continuously followed after the heat treatment described above.

In the second aspect of the invention, when molded product of a predetermined shape is heat treated in an inert gas atmosphere after the magnet material is added with the non-metallic inorganic binder as described above, the magnet material prepared by the melt quenching method is bonded together into a unitarized form by the inorganic binder with its crystal formation unchanged. By this low-temperature heat treatment, the inorganic binder in the mold product is melted and eluted to the surface to thereby shut off the pores thereof. Thus, the mold product is "coated" with the eluted binder so that the coated layer serves also as an anti-oxidizing film. The coated layer is an air-tight layer which effectively improves the isostatic press treatment. In other words, the inner pores are compressed for densification.

Examples of producing the anisotropic magnet will be described.

EXAMPLES 6

As a starting material, an alloy composed of 13 atom % of neodymium (Nd), 82.7 atom % of iron (Fe), 4.3 atom % of boron (B) was prepared by a high frequency melting furnace. The resultant alloy was treated by a single-roll method to form quenched ribbon and then subjected a heat treatment. The heat-treated ribbon was pulverized to 100–1000 μm (micron) to obtain magnet material. This material was magnetically isotropic. Thereafter, the magnet material was supplied into a mortar and a sealed container for the mortar was substituted with argon gas, and heated at 750° C., followed by a 30 minutes stamping for pulverization. The pulverized powder is a scaly form and an average particle size of the pulverized powder was about 30 μm or less by the measurement of air penetration method.

The resultant powder was mixed with 0.2 wt % of zinc stearate, 0.8 wt % of lead-lithium glass powder and 22 wt % of 5 %-solution of polyvinyl alcohol and then formed into a cake-shape. The cake shaped material was pressed by a mixing roller which was heated at 60° C. to gradually press and dehydrate the material, so that the scaly powder was formed into mechanically oriented flakes. The flakes was granulated and classified to obtain oriented granules having a particle size of 200 μm in diameter. The granules were press-molded at a molding pressure of 5 t/cm$^2$ in a orientational magnetic field. The molded product was heated up to an elevated temperature of 140 ° C., and dried air was supplied thereto for heat-decomposition of the polyvinyl alcohol. Then, it was substituted by nitrogen atmosphere and deaerated to vacuum of $10^{-2}$ mmHg and heated at an elevated temperature up to 780° C. for 30 minutes, followed by rapid cooling. The resultant product (anisotropic magnet) had a specific gravity of 6.2 and magnetic characteristics: 9,400 G of residual flux density, 8,200 Oe of coersive force and 25 MGOe of maximum energy product.

After the 780° C. heat-treatment described above, this temperature was maintained and argon gas was injected thereto, and then a high pressure heat treatment of 2,000 atmospheric pressure was carried out for 20 minutes. Then, decompression and rapid cooling (quenching) were conducted at the same time to produce a product of high density. This densified product had a specific gravity of 7.3 and magnetic characteristics: 10,500 G of residual magnetic flux density, 9,500 Oe of coersive force and 25 MGOe of maximum energy product.

EXAMPLE 7

The similar powder as that of Example 6 was used and 0.8 wt % of lead-lithium glass powder and water are mixed therewith to produce slurry. The slurry was compressed in an orientational magnetic field and dehydrated and, at the same time, molded. This product was dried and then subjected to substitution in nitrogen atmosphere containing 180 ppm of hydrogen gas, and deaerated to $10^{-2}$ mmHg. Thereafter, it was heated at an elevated temperature up to 780° C. for 30 minutes and then subjected to rapid cooling. This heat-treated product had a specific gravity of 6.2 and magnetic characteristics: 9,500 G of residual magnetic flux density, 9,700 Oe of coersive force and 21 MGOe of maximum energy product.

After the 780° C. heat-treatment described above, this temperature was maintained and argon gas was injected thereto, and then a high pressure heat treatment of 2,000 atmospheric pressure was carried out for 20 minutes. Then, decompression and rapid cooling (quenching) were conducted at the same time to produce a product of high density. This densified product (anisotropic magnet) had a specific gravity of 7.2 and magnetic characteristics: 11,200 G of residual magnetic flux density, 9,800 Oe of coersive force and 27.5 MGOe of maximum energy product.

EXAMPLE 8 (ISOTROPIC MAGNET)

As a starting material, an alloy composed of 13 atom % of neodymium (Nd), 82.7 atom % of iron (Fe), 4.3 atom % of boron (B) was prepared by a high frequency melting furnace. The resultant alloy was treated by a single-roll method to form quenched ribbon and then subjected a heat treatment. The heat-treated ribbon was pulverized to 5–50 μm (micron) to obtain magnet material. This material was magnetically isotropic.

The resultant powder was mixed with 0.2 wt % of zinc stearate, 0.2 wt % of phosphorous pentaoxide and 12 wt % of 5%-solution of polyvinyl alcohol and then granulated to an average particle size of 200 μm in diameter. Then the granulated material was pressed by a powder molding mill at a molding pressure of 5 t/cm$^2$. The molded product was heated at an elevated temperature up to 140° C., and dried air was supplied thereto for heat-decomposition of the polyvinyl alcohol. Then, it was substituted by nitrogen atmosphere and deaerated to vacuum of $10^{-2}$ mmHg and heated at an elevated temperature up to 780° C. for 30 minutes, followed by rapid cooling (quenching). The resultant product (isotropic magnet) had a specific gravity of 6.2 and magnetic characteristics: 7,900 G of residual flux density, 6,700 Oe of coersive force and 13.2 MGOe of maximum energy product.

After the 780° C. heat-treatment described above, this temperature was maintained and argon gas was injected thereto, and then a high pressure heat treatment of 2,000 atmospheric pressure was carried out for 20 minutes. Then, decompression and rapid cooling were conducted at the same time to produce a product of high density. This densified product had a specific gravity of 7.1 and magnetic characteristics: 8,800 G of residual magnetic flux density, 7,100 Oe of coersive force and 14 MGOe of maximum energy product.

As described above, in the second aspect of the present invention, the non-metallic inorganic binder is added to the rare earth magnet powder which has been obtained by melt quenching method so that powders are bonded together by the melting of the binder in the step of heat treatment of a relatively low temperature with the crystal formation being unchanged. Therefore, the desirable magnetic properties which are inherent to the powder used in the invention can be utilized as they are.

Further, the binder eluted on to the surface of the product can close the pores thereof and, accordingly, the following isostatic pressing step can be effected for densification and improvement in the magnetic properties can be obtained.

What is claimed is:

1. A method of producing a rare earth anisotropic bonded magnet material in the form of scaly particles comprising the steps of:

melting an alloy composed of 10–30 atom % of R (wherein R designates at least one rare earth element including yttrium), 2–28 atom % of boron and 65–82 atom % of M (wherein M designates at least one of iron, cobalt and nickel) and melt quenching the melted alloy to produce a powder material, subjecting the material to pressing at a temperature of 300°–900° C. in an inert gas atmosphere to pulverize the material to scaly particles, and cooling the scaly particles so that a magnetic anisotropy is produced in a perpendicular direction relative to the pressed surface.

2. A method of producing a rare earth anisotropic bonded magnet material in the form of scaly particles comprising the steps of:

melting an alloy composed of 10–30 atom % of R (wherein R designates at least one rare earth element including yttrium), 2–28 atom % of boron and 65–82 atom % of M (wherein M designates at least one of iron, cobalt and nickel) and melt quenching the melted alloy to produce powder material, preheating said material at 700°–900° C. and then heat-pressing the preheated material at 800°–900° C. by means of a roller mill to compress and pulverize said preheated material to produce scaly particles.

3. The method according to claim 1, wherein said inert gas atmosphere contains at least one of argon gas, nitrogen gas and the mixture thereof with a small amount of hydrogen added thereto.

4. A method of producing a pellet for forming a rare earth anisotropic bonded magnet comprising:

a. adding and mixing a resin with a magnetic material obtained from a method which comprises:

melting an alloy composed of 10–30 atom % of R (wherein R designates at least one rare earth element including yttrium), 2–28 atom % of boron and 65–82 atom % of M (wherein M designates at least one of iron, cobalt and nickel) and melt quenching the melted alloy to produce a powder material, subjecting the material to pressing at a temperature of 300°–900° C. in an inert gas atmosphere to pulverize the material to scaly particles, and cooling the scaly particles so that a magnetic anisotropy is produced in a perpendicular direction relative to the pressed surface, b. subjecting the resulting mixture to magnetic orientation to produce an intermediate product and c. granulating the intermediate product to produce a pellet for forming an anisotropic bonded magnet.

5. A method of producing a pellet for forming a rare earth anisotropic bonded magnetic comprising:

a. adding and mixing a resin with the anisotropic bond magnetic material obtained from a method which comprises:

melting an alloy composed of 10–30 atom % of R (wherein R designates at least one rare earth element including yttrium), 2–28 atom % of boron and 65–82 atom % of M (wherein M designates at least one of iron, cobalt and nickel) and melt quenching the melted alloy to produce powder material, preheating said material at 700°–900° C. and then heat-pressing the preheated material at 800°–900° C. by means of a roller mill to compress and pulverize said preheated material to produce scaly particles, b. subjecting the resulting mixture to magnetic orientation to produce an intermediate product and c. granulating the intermediate product to produce a pellet for forming an anisotropic bonded magnet.

6. A method of producing a rare earth bonded magnet comprising the steps of:

melting an alloy composed of 10–30 atom % of R (wherein R designates at least one rare earth element including yttrium), 2–28 atom % of boron and 65–82 atom % of M (wherein M designates at least one of iron, cobalt and nickel) and subjecting the melted alloy to a melt quenching method to produce a magnetic powder, adding a non-metallic inorganic binder to the magnetic powder to form a mixture, subjecting the mixture of the non-metallic inorganic binder and magnetic powder to molding at room temperature, heat-treating the molded product in an inert gas atmosphere at a temperature of 600°–900° C. to thereby form said bonded magnet.

7. A method of producing a rare earth anisotropic bonded magnet comprising the steps of:

melting an alloy composed of 10–30 atom % of R (wherein R designates at least one rare earth element including yttrium), 2–28 atom % of boron and 65–82 atom % of M (wherein M designates at least one of iron, cobalt and nickel) and melt quenching the melted alloy to produce a powder material, subjecting the material to pressing at the temperature of 300°–900° C. in an inert gas atmosphere to pulverize and press the material to scaly particles, and cooling the scaly particles so that a magnetic anisotropy is produced in a vertical direction relative to the pressed surface, adding a non-metallic inorganic binder to the scaly particles to form a mixture, molding the in an orientational magnetic field at room temperature to form a molded product, and heat-treating the molded product in an inert gas atmosphere at a temperature of 600°–900° C. so that the scaly particles are bonded together by melting of the binder thereby forming an anisotropic bonded magnet.

8. A method of producing a rare earth anisotropic bonded magnet comprising the steps of:

a. melting an alloy composed of 10–30 atom % of R (wherein R designates at least one rare earth element including yttrium), 2–28 atom % of boron and 65–82 atom % of M (wherein M designates at least one of iron, cobalt and nickel) and melt quenching the melted alloy to produce powder material, b. subjecting the material to pressing at a temperature of 300°–900° C. in an inert gas atmosphere to pulverize the material to scaly particles, and c. cooling the material so that a magnetic anisotropy is produced in a perpendicular direction relative to the pressed surface, d. adding a non-metallic inorganic binder to the scaly particles, e. subjecting the scaly particles and binder to a a roller to form flakes, f. granulating the flakes and molding the granulated material at room temperature in an orientational magnetic field, and g. heat-treating the molded product in an inert gas atmosphere at 600°–900° C. so that the scaly particles are bonded together by melting of the binder.

9. The method according to claim 7, wherein after the material is bonded, the material is heat-treated for densification by means of a high temperature gas isostatic press.

* * * * *